United States Patent [19]

Bonasch et al.

[11] 4,380,254

[45] Apr. 19, 1983

[54] WEFT GUIDANCE TUBE FOR LOOMS

[75] Inventors: James H. Bonasch, East Greenwich, R.I.; William J. Bouchard, Jr., Fall River, Mass.

[73] Assignee: Leesona Corporation, Warwick, R.I.

[21] Appl. No.: 299,848

[22] Filed: Sep. 8, 1981

[51] Int. Cl.[3] ..... D03D 47/30

[52] U.S. Cl. ..... 139/435

[58] Field of Search ..... 139/435, 188, 192, 439; 226/97

[56] References Cited

U.S. PATENT DOCUMENTS

| | | | |
|---|---|---|---|
| 3,075,560 | 1/1963 | Pfarrwaller | 139/188 |
| 3,139,118 | 6/1964 | Svaty et al. | 139/435 |
| 4,319,611 | 3/1982 | Foltyn et al. | 139/435 |

FOREIGN PATENT DOCUMENTS

| | | | |
|---|---|---|---|
| 8001447 | 9/1980 | Netherlands | 139/435 |
| 2072719 | 10/1981 | United Kingdom | 139/435 |

*Primary Examiner*—Henry Jaudon

*Attorney, Agent, or Firm*—Burnett W. Norton

[57] ABSTRACT

A weft guidance tube for a fluid weft insertion system of weaving apparatus includes an elongated member having a longitudinal channel therein. A plurality of segments are juxtaposed in the channel. Each of the segments includes a base and an upper end, with the upper end having an aperture therein and an exit slot extending from the aperture. The base of each segment is wider in cross-section than the upper end thereof. Connecting pins project outwardly from one side of each base to thereby permit connection of adjoining segments to each other. When so connected the apertures and exit slots of all of the segments arranged in the channel are in proper alignment and the upper end of each segment is spaced apart from the upper end of adjoining segments by a distance goverend by the width of bases of the segments. The plurality of segments are secured to the channel by suitable gripping means.

11 Claims, 8 Drawing Figures

WEFT GUIDANCE TUBE FOR LOOMS

BACKGROUND OF THE INVENTION

The present invention relates to weaving looms of the type wherein a pulse or current of a fluid such as air is employed to carry weft across a shed and relates, more particularly, to a new and improved weft guidance tube for directing the pulse or current of fluid and the weft conveyed thereby across such shed, and to a novel segment for use in constructing such weft guidance tubes.

Guidance tubes for conducting weft through the shed of a loom are well known in the art as exemplified by the following U.S. Pat. Nos. 3,139,118 to Svaty, et als; 3,065,770 to Svaty, et als; 3,203,452 to Svaty, et als; 3,557,645 to Svaty, et als; 3,796,236 to Kamp; and 3,847,187 to Buran et al. Such guidance tubes rather typically include a row of segments cemented into a common mounting member, with each segment having an aperture therethrough into which a fluid such as air and weft entrained in the air are directed. Each segment has an outlet through which the weft can exit as the tube is withdrawn from the shed prior to beat up of the weft into the fabric being woven on the loom. In operation with such tubes it is essential that the segments when assembled in their common mounting member be arranged in virtually perfect alignment with respect to each other. That is to say, the apertures of all of the plurality of segments must be essentially perfectly aligned, the exit slots of the segments must similarly be in perfect alignment, and the segments must be uniformly and properly spaced from each other, all to the end that the weft and the air moving through the tube will not experience turbulence, interruption, or under escape from the tube, that the air will not undergo undue leakage out of the tube, and that the weft can readily exit from the tube at the proper instant without being trapped in any of the segments at the moment of beat up. In the absence of the characteristics just stated, the weft may not be properly propelled across the shed, and the weft may not fully exit from the tube at the proper instant. Either condition results in a weaving malfunction.

It has been found in practice with prior art weft guidance tubes that they are difficult to assemble, that such assembly represents a tedious and time-consuming task, and the requisite degree of alignment and spacing of the parts is extremely difficult to achieve. These difficulties obtain from a variety of independent shims or spacers located between individual segments to establish the gap therebetween. Further, in the prior art a mandrel or other means is employed in an effort to achieve the desired alignment of the apertures and exit slots of the plurality of segments. Further an epoxy or cement is used to fasten the segments in their mounting member. Keeping in mind that weft guidance tubes frequently include up to six or more segments per inch and that currently available weft guidance tubes commonly range up to 48 inches or more in length, it is readily apparent that proper assembly of such tubes is an extremely difficult and time-consuming task.

The present invention is particularly directed to a new and improved weft guidance tube which incorporates efficiencies not hereinbefore known in the art.

SUMMARY OF THE INVENTION

In accordance with the present invention a weft guidance tube is provided which includes an elongated member having a longitudinal channel therein. A plurality of segments of the unique construction are arranged in side-by-side relationship in the channel. Each of the segments includes a base and an upper end. Each upper end has an aperture therein and an exit slot extending from the aperture. Desirably, each aperture is tapered in the direction of fluid flow and weft movement through the guidance tube. The segments are constructed so that the base of each is wider in cross-section than the upper end of the segment. Each base has a plurality of projections extending outwardly from one side thereof and the opposite side of the base has a number of holes for receiving such projections. In this manner, an array of such segments can be secured in juxtaposition with the projections of one segment press-fitted into the holes of an adjacent segment, and all of the segments can be so ganged that they are readily assembled into the channel of the elongated member which is the common holding means for all of the segments. When so assembled, the apertures of all of the segments reside in alignment with each other, and similarly, the exit slots are aligned with each other. Further, accurate spacing of the upper ends of adjacent segments is attained by virtue of the relatively wide construction of the base of the segments. Thereafter, the array of segments may be secured in the common supporting member either by constituting the supporting member as a two-section element which is clamped onto the segments by suitable means or, in the alternative, the segments may be secured in the member by means of one or more binder rods which act as wedges. If desired, the channel member may include end caps to further assist in retaining the array of segments in the channel member. Such construction obviates the need for cementing the segments in the elongated member.

OBJECTS OF THE INVENTION

It is one object of the invention to provide a new and improved weft guidance tube for use in fluid weft insertion systems.

it is a further object of the present invention to provide a weft guidance tube which is easy to assemble and durable and reliable in use.

Still a further object of the present invention is to provide a weft guidance tube for fluid weft insertion systems which comprises an elongated member having a longitudinal channel therein, a plurality of segments mounted in side-by-side relationship in the channel with each of the segments having a base and an upper end, the upper end having an aperture therein and an exit slot extending from the aperture, and with the base of each segment being wider in cross-section than the upper end of each segment, and each said segment having means to join it to adjacent segments with the apertures and exit slots of all of the segments so connected being spaced from the upper end of adjoining segment.

A further object of the present invention is to provide a new and novel segment construction for incorporation in a weft guidance tube for fluid weft insertion systems wherein the segment includes an upper end and a base, the upper end having an aperture therein and an exit slot extending therefrom, the base being wider in cross-section than the upper end of the segment, the segment being provided with connecting means whereby said segment may be joined with further segments and the apertures and exit slots of all of the segments being in alignment, the upper sections of the segments being spaced from each other, and the base being arranged to be gripped in a channel member for holding all of the segments.

Other objects of the invention will, in part, be obvious and will, in part, appear hereinafter.

DESCRIPTON OF THE PREFERRED EMBODIMENT

Figure 1:
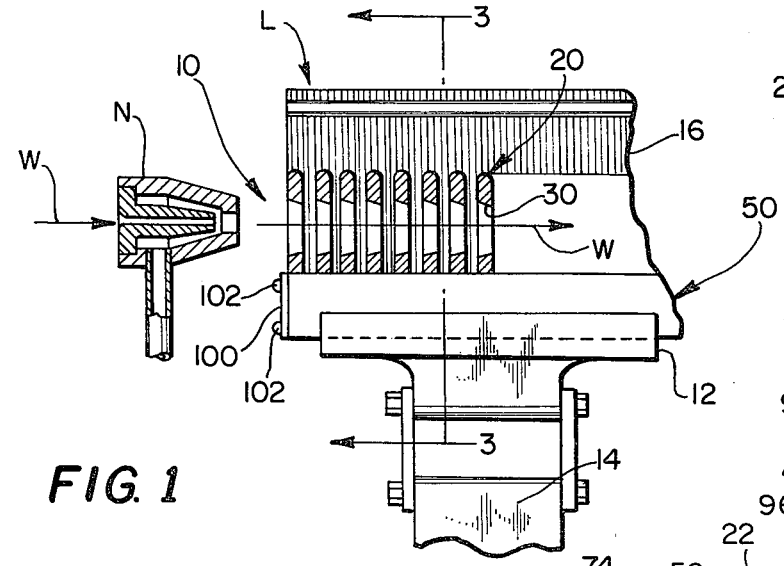
FIG. 1 is a fragmentary front elevational view of the improved weft guidance tube of the present invention mounted in operative position on a loom and depicting the fluid jet for inserting a pulse or current of fluid such as air together with the weft into the guidance tube.
Figure 2:
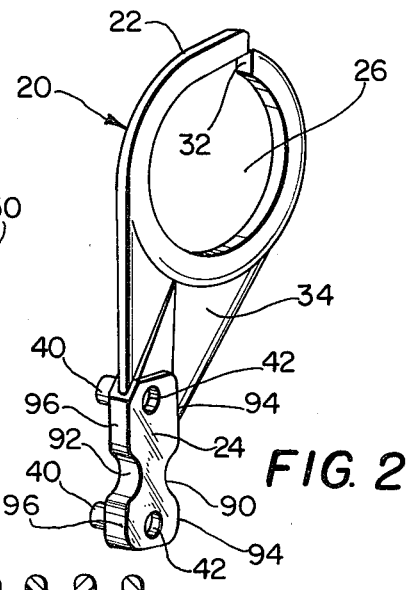
FIG. 2 is a perspective view of one segment of the plurality of segments constituting the weft guidance tube;.

With attention initially directed to FIG. 1, the new and improved weft guidance tube 10 of the present invention is illustrated in its operative position on a loom L supported in mounting bracket 12 which, in turn, is connected with a plurality of generally upstanding driving links, one of which is shown at 14 in FIG. 1. Further particulars of the means for mounting the weft guidance tube may be the same as that described in detail in commonly assigned U.S. patent application Ser. No. 64,180 filed Aug. 6, 1979 which is herein incorporated by reference. As is fully disclosed in that U.S. patent application, weft guidance tube 10 is withdrawn from its operative position within the interior of a loom shed before the reed 16 of the loom L reaches the beat up position to thereby permit the weft W to float free within the shed before being pressed against the fell of the fabric by the forward motion of reed 16. Additionally, and also as is fully disclosed in the prior cited U.S. patent application a weft insertion nozzle N is operative to expel a pulse of air on signal to propel the weft W, entrained in the air, across the shed of the loom, the weft passing through weft guidance tube 10 during its travel from one side of the shed to the other.

Figure 4:
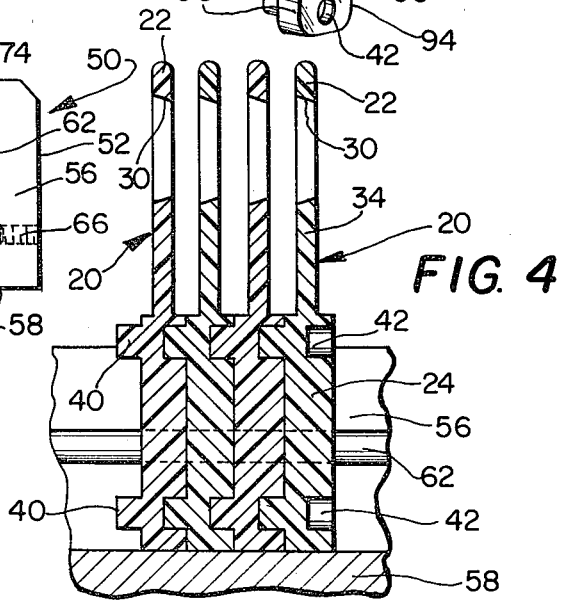
FIG. 4 is a view taken along lines 4—4 of FIG. 3.

Weft guidance tube 10 includes a plurality of tooth-like segments 20, each of which has a ring-like upper end 22 and a base 24. Desirably, the segments are manufactured as one-piece elements and may be formed of plastic such as acetal resin which is injection moulded. Since all of the segments 20 constituting weft guidance tube 10 are alike in construction it will suffice to describe but one segment in detail. Therefore, and with particular attention at this time to FIGS. 2–4, it will be observed that the upper ring-like end 22 of each segment 20 has a generally circular aperture 26 therein through which the pulse of air emitted by nozzle N, and the weft W entrained in the air, move. The inner surface 30 of each aperture is defined by a generally smooth tapering surface of approximately 6° which forms a part of a cone whose apex is in the direction of movement to the weft, that is, toward the right viewing FIG. 1. An exit slot 32 extends outwardly from aperture 26 to permit removal of the weft W from aperture 26 as the weft guidance tube 10 is removed from the shed of the loom preliminary to beat up of the weft to the fell of the fabric as more particularly described in the prior cited patent application. Viewing FIGS. 2 through 7 it will be seen that segment 20 includes a web 34 connecting the upper end 22 with the base 24. As is best seen in FIG. 4, web 34 is generally of the same thickness as the upper end 22. A gusset 36 may be moulded into the side of web 34 to provide a means for stiffening the web. With continuing reference to FIG. 4, base 24 is substantially wider in cross-section than is the upper end 22 of segment 20. Further, base 24 is provided with a plurality of pin-like projections 40 which extend laterally outward from the left hand side of each segment as seen in FIG. 4. On the opposite, or right hand side of each segment (viewing FIG. 4) a plurality of holes 42 equal in number to the projections 40 in the opposite, or left hand side of base 24 are formed. These holes 42 are at least as deep as the length of the projections 40 and are of a diameter to permit projections 40 of an adjacent segment 22 to be fitted in the holes 42 under a slight pressure thereby providing a frictional grip between adjacent segments. The center of each of the holes 42 is coaxial with the companion projections 40 on the opposite side of the related segment. Thus, as a plurality of segments 20 are assembled in juxtaposition as shown in FIGS. 1 to 4 the bases 24 of the segments are aligned with each other. The upper ends 22 and the apertures 26 therein of all of the segments 20 in the assembly automatically reside in alignment with each other. In like manner, the exit slots 32 of the plurality of segments 20 in the assembly also reside in a common line. Thus, by the simple expedient of press-fitting a plurality of segments 20 of the present invention together by engaging the projections 40 of one segment into the holes 42 of another segment in the manner as aforesaid, essentially perfect alignment of the assembly of segments is achieved to construct weft guidance tube 10.

The necessity for precise spacing of the segments 20 with respect to each other has already been alluded to and the importance of such precise alignment to the proper functioning of the weft guidance tube of the present invention has also been brought forth. As is readily evident in FIG. 4 the base 24 of each segment 20 admirably provides a means for controlling the spacing between each of the upper ends 22 of the segments 20 as the plurality of segments are joined together. In practice with the present invention the cross-sectional dimension of all of the segments 20 in the array constituting weft guidance tube 10 are typically formed so that the bases 24 thereof are of a common cross-sectional width which is greater than the cross-section of the upper ends 22 of the segments 20. Thereby as the segments 20 are arrayed together as shown in FIG. 4 the spacing between segments 20 is uniform from one end to the other of the weft guidance tube 10. In contradistinction to the construction of the present invention it has been usual in the prior art to manufacture segments which were substantially of equal thickness in their cross-sectional dimension from top to bottom. Thus, in the prior art it was necessary to insert independent shims or spacers between the adjacent segments to provide the requisite space between the upper ends thereof. The utilization of such independent spacers led to a variety of problems, among which were the necessity to utlize spacers of even thickness in constructing the tube to insure that the gaps between the upper ends of all of the segments in the prior art tubes were equal. Additionally, the additional steps of inserting spacers between each of the segments was a time-consuming activity. Furthermore, the employment of the independent spacers led to increased costs in constructing the prior art tubes.

The present invention includes novel and efficient means for mounting the array of segments 20 for utilization on loom L. To this end, and with attention firstly to FIGS. 6, 7 and 8, it will be seen that guidance tube 10 includes an elongated rigid element 50 constituted as two members 52 and 54. Member 52 is essentially a right-angle member having an upstanding section 56 and a leg 58 extending generally horizontally from the lower portion thereof. The interior of member 52 is formed generally as a flat wall 60 which has a rib 62 extending longitudinally therealong from one end of member 52 to the opposite end thereof. Rib 62 is arranged generally along the mid-line of member 52. The face 64 of leg 58 has a series of tapped holes 66 therein to receive threaded cap screws 70 which pass through member 54 and threadedly engage in the holes 66 to thereby join the two members 52 and 54 together in a manner as shown in FIG. 7 to define a channel 74 between the two members.

Figure 8:
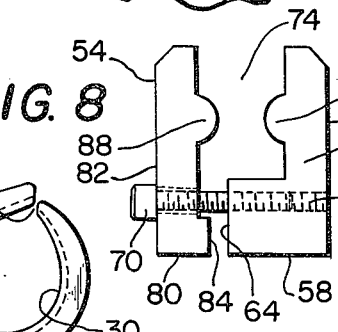
FIG. 8 is an exploded view in side elevation of the segment mounting means of FIGS. 6 and 7.
Figure 6:
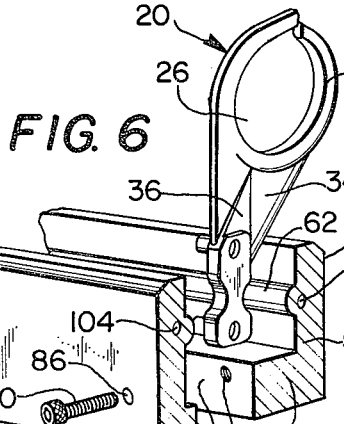
FIG. 6 is a view similar to FIG. 5 illustrating a modified means for securing the plurality of segments in their mounting member.
Figure 7:
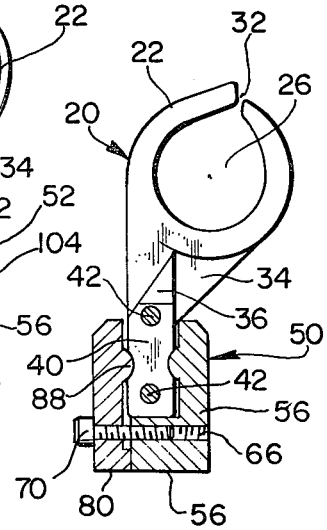
FIG. 7 is a side elevational view partly in section illustrating a segment secured in the mounting means of FIG. 6.

Turning attention now to member 54, it will be seen particularly from FIGS. 6 and 8 that this member is configured generally as an elongated rigid generally flat plate which is co-extensive in length and height with its companion member 52. The lower end of member 54 has a slight right-angle extension 80 extending from upstanding portion 82 of that member. Extension 80 presents a face 84 which is smaller in vertical dimension than the face 64 of leg 58. Slightly upwardly from extension 80 there is a series of holes 86 drilled through member 54 for receiving cap screws 70 which, when drawn in tightly to member 52, bind the two members 52, 54 in engagement with segments 20 in channel 74. When cap screws 70 are backed off to provide some freedom of movement between the respective members 52 and 54 the faces 64 and 84 of leg 58 and extension 80, respectively, serve as pivoting surfaces on which members 52 and 54 can be rocked relative to each other to provide relief from the clamping effect of the members on the segments 20 situated in channel 74. With such relief provided, segments 20 can be slid longitudinally in channel 74. When cap screws 70 are drawn tightly into the threaded holes 66 members 52 and 54 are rocked on their faces 64, 84 to cause the members 52 and 54 to be rocked into binding engagement with the segments 20. To the end that member 54 may exert a gripping action on said segments 20 a rib 88 is formed on the interior face of this member in horizontal alignment with the companion rib 62 of member 52. Thus, the two ribs 62 and 88 exert oppositely directed forces to clamp the segments in channel 74. As may be seen in FIGS. 2, 6 and 7 the base of each segment 20 has opposing recesses 90, 92 formed therein. When segments 20 are situated in channel 74 the recesses 90, 92 reside in alignment with ribs 92, 90, respectively. Thus, the ribs 90 and 92, when drawn into clamping position by clamp screws 70, bind tightly into the recesses 90, 92 of segment 20 pressing firmly against the walls of those recesses. The spacing of the interior walls of the channel upwardly and downwardly from the ribs 56 and 58 above and below ribs 56 and 88 are flat. The side walls 94, 96 of base 24 are similarly flat. Consequently, as members 52 and 54 are drawn in their clamping position via cap screws 70 the interior walls of the two members 52, 54 clamp onto the side walls 94, 96 of base 24 in the manner as shown in FIG. 7. Therefore, there is generally full clamping action by the members 52, 54 on the segments 20 situated within channel 74 to secure the segments within the channel. If it is desired for any reason to remove the segments 20 vertically out of channel 74, cap screws 70 are disengaged from members 52, 54 to separate these members as shown in FIG. 8.

End caps 100 may be provided to further secure the array of segments 20 in channel 74 if desired. These end caps are held in place by a plurality of screws 102 engaging in tapped holes 104 in the end walls of the channel members 52 and 54.

Figure 3:
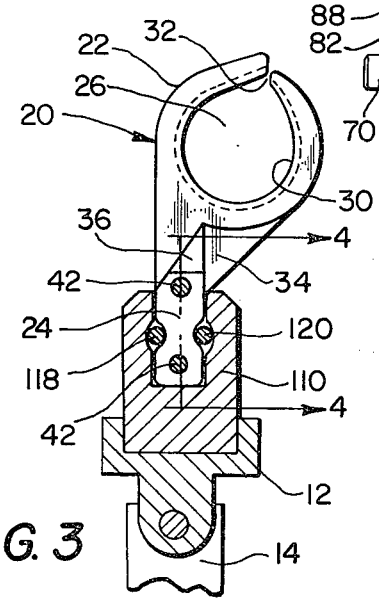
FIG. 3 is a view taken along lines 3—3 of FIG. 1.
Figure 5:
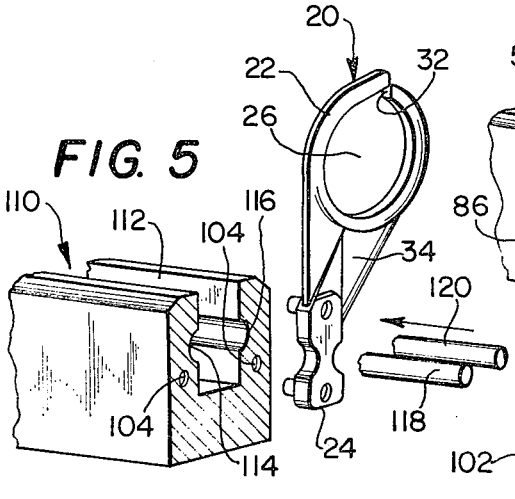
FIG. 5 is an exploded view illustrating one embodiment of the means for securing the plurality of segments in their mounting member.

A modified form of means for engaging the segments in the channel is illustrated in FIGS. 3 and 5. In these views the mounting means for the array of segments 20 is constituted as a single member 110 having a channel 112 milled longitudinally therealong from one end to the other. The channel 112 has opposing recesses 114, 116 milled into the opposing faces of the channel. When segments 20 are situated within channel 112 opposing rods 118, 120 are force-fitted into the clearance between the recesses 114, 116 and the receses 90, 92 formed in the base of the array of segments. These rods exert a wedging or clamping action on the array of segments to secure such segments in position within the channel member 110.

It is to be noted that in either of the embodiments of the mounting means for containing the array of segments 20 disclosed herein, the requirement for cementing the segments in the channel of the mounting means as existed in the prior art is obviated. Consequently, simple and efficient securing of the segments in the channel can be accomplished all to the end that rapid and efficient assembly of the segments can be attained.

From the foregoing it will be seen that the present invention provides a new and improved weft guidance tube for use in fluid weft insertion systems which is easy to assemble, durable and reliable in use and which represents a significant advance in the art.

It should be apparent from the foregoing that the present invention may be embodied in other specific forms without departing from the spirit or essential attributes thereof, all of which are intended to be encompassed by the appended claims.

What is claimed is:

1. A weft guidance tube for a fluid weft insertion system comprising, an elongated member having a longitudinal channel therein, a plurality of segments juxtaposed in said channel, each said segment including a base and an upper end, said upper end having an aperture therethrough and an exit slot extending from said aperture, connecting means on each segment for connecting each segment to an adjacent segment with the apertures and exit slots of said segments being in alignment, the base of each said segment being wider in cross-section than the upper end thereof to thereby space said upper ends from each other when said segments are juxtaposed, and means for securing said plurality of segments in said channel.

2. A weft guidance tube as set forth in claim 1 wherein said connecting means includes a plurality of pins protruding from one side of each segment and pin receiving holes formed in the opposite side of said segment.

3. A weft guidance tube as set forth in claim 1 wherein said apertures are defined by an inclined boundary surface, and including a source for a fluid and weft projected into said tube, said apertures narrowing in the direction of movement of said fluid and weft through said tube.

4. A weft guidance tube as set forth in claim 3 wherein said source for said fluid and weft is aligned coaxially with said tube.

5. A weft guidance tube as set forth in claim 1 wherein said means for securing said segments includes slot means within said channel, and wedge means engagable in said slot means and arranged to bear on said segments to thereby secure said segments in said channel.

6. A weft guidance tube as set forth in claim 1 wherein said elongated member includes first and second sections, fastening means for joining said first and second sections together with said channel defined between said sections, and rib means within said channel arranged to engage with said segments to thereby secure said segments in said channel.

7. A weft guidance tube as set forth in claim 6 wherein the base of each segment is provided with recess means for receiving said rib means.

8. A weft guidance tube as set forth in claim 6 wherein said first and second members include respective contact surfaces, said first and second members being rockable relative to each other on said surfaces to thereby permit sliding movement of said segments along said channel while precluding movement of said segments upwardly in said channel.

9. A segment for use in a weft guidance tube wherein a fluid and weft entrained in the fluid are projected into said tube comprised of a plurality of such segments for delivery through the shed of loom comprising; a base and an upper end, said upper end having an aperture therethrough and an exit slot extending from said aperture, connecting means on said segment for connecting said segment to an adjacent segment with the aperture of said segment and said adjacent segment being in alignment, the base of said segment being wider in cross-section than said upper end thereof to thereby space the upper end of said segment from the upper end of said adjacent segment when said segments are connected, and means on said base for connection with a member for holding said segment.

10. A segment as set forth in claim 9 wherein said aperture is defined by a boundary surface inclined inwardly in the direction of movement of said fluid and weft therethrough.

11. A segment as set forth in claim 9 wherein said connecting means includes pin means protruding from one side of said segment and pin receiving hold means on the opposite side of said segment.

* * * * *